US006557362B1

(12) United States Patent
Wilson

(10) Patent No.: US 6,557,362 B1
(45) Date of Patent: May 6, 2003

(54) SEALED SYSTEM MULTIPLE SPEED COMPRESSOR AND DAMPING CONTROL

(75) Inventor: Mark Wayne Wilson, Simpsonville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/113,900

(22) Filed: Mar. 29, 2002

(51) Int. Cl.[7] ..... F25D 17/04; F25B 19/00
(52) U.S. Cl. ..... 62/187; 62/231
(58) Field of Search ..... 62/187, 231, 203, 62/163, 155, 156, 151, 126, 186

(56) References Cited

U.S. PATENT DOCUMENTS 4,843,833 A 7/1989 Polkinghorne
4,879,878 A 11/1989 Polkinghorne
5,471,849 A 12/1995 Bessler
5,996,361 A 12/1999 Bessler
6,125,641 A * 10/2000 Kim et al. ..... 62/187

FOREIGN PATENT DOCUMENTS

JP 10038433 A * 2/1998

* cited by examiner

*Primary Examiner*—Chen Wen Jiang
(74) *Attorney, Agent, or Firm*—H. Neil Houser, Esq.; Armstrong Teasdale LLP

(57) ABSTRACT

A method for controlling a damper having a closed position and an open position for providing flow communication between a first cooled compartment and a second cooled compartment is provided. The method includes toggling the damper from an initial position of the damper to a position different from the initial position and then back to the initial position on a periodic basis.

20 Claims, 6 Drawing Sheets

← FIG. 3B

SEALED SYSTEM MULTIPLE SPEED COMPRESSOR AND DAMPING CONTROL

BACKGROUND OF THE INVENTION

This invention relates generally to sealed system refrigeration devices, and more particularly, to controlling a damper in refrigerators.

Modern refrigerators typically include a compressor, an evaporator, and a condenser in a closed refrigeration circuit, and a number of fans that facilitate the refrigeration circuit and direct cooled air into refrigeration compartments. Conventionally, the condenser, evaporator and condenser are operated at a single speed, and a plurality of single speed fans are employed in association with the condenser, evaporator, condenser and also to direct cooled air throughout the refrigerator. Collectively, these components are sometimes referred to as a sealed system. While these single speed sealed systems have been satisfactory in the past, they are now perceived as disadvantageous in several aspects.

For example, such single speed systems often entail considerable temperature variation in operation of the refrigerator as the sealed system cycles on an off. Further, the refrigerator can sometimes be undesirably noisy as it cycles from an off or relatively silent condition to an on condition with the sealed system components energized. In addition, single speed systems are not as energy efficient as desired.

While most of these disadvantages can be addressed by using multiple speed or variable speed fans and sealed system components, use of variable speed components has caused changes in the way refrigerators are operated. For example, in variable systems the duty cycle of the compressor is nearly continuous while in single speed systems the duty cycle is much less than nearly continuous. For example, in one known single speed system the duty cycle is 50%. However, a nearly continuous duty cycle may cause undesirable ice build up.

BRIEF DESCRIPTION OF THE INVENTION

In one aspect, a method for controlling a damper having a closed position and an open position for providing flow communication between a first cooled compartment and a second cooled compartment is provided. The method includes toggling the damper from an initial position of the damper to a position different from the initial position and then back to the initial position on a periodic basis.

In another aspect, a cooling device includes a first compartment including a plurality of first walls and at least one first door defining a first enclosed volume of the first compartment and a second compartment including a plurality of second walls and at least one first door defining a first enclosed volume of the second compartment with one of the first walls. A damper is between the first compartment and the second compartment, the damper is movable to change an amount of flow communication between the first compartment and the second compartment. A sealed system is configured to provide cooling capacity to the first compartment and the second compartment is operationally coupled to the first compartment and to the second compartment. A temperature control system is operationally coupled to the damper and to the sealed system. The control system is configured to toggle the damper from an initial position to a position different from the initial position and then back to the initial position on a periodic basis.

In a further aspect, a refrigerator includes a first compartment configured to preserve food, the first compartment including a plurality of first walls and at least one first door defining a first enclosed volume of the first compartment, and a second compartment configured to preserve food coupled to one of the first walls, the second compartment including a plurality of second walls and at least one second door defining a second enclosed volume of the second compartment with one of said first walls comprising a damper movable to change an amount of flow communication between the first compartment and the second compartment. A sealed system is operationally coupled to the first and second compartments, the sealed system is configured to provide cooling capacity to the first and second compartments. A temperature control system is operationally coupled to the sealed system and to the damper. The control system is configured to maintain the first compartment at a first temperature, maintain the second compartment at a second temperature different from the first temperature, and toggle the damper from an initial position to a position different from the initial position and then back to the initial position on a periodic basis.

DETAILED DESCRIPTION OF THE INVENTION

Figure 1:
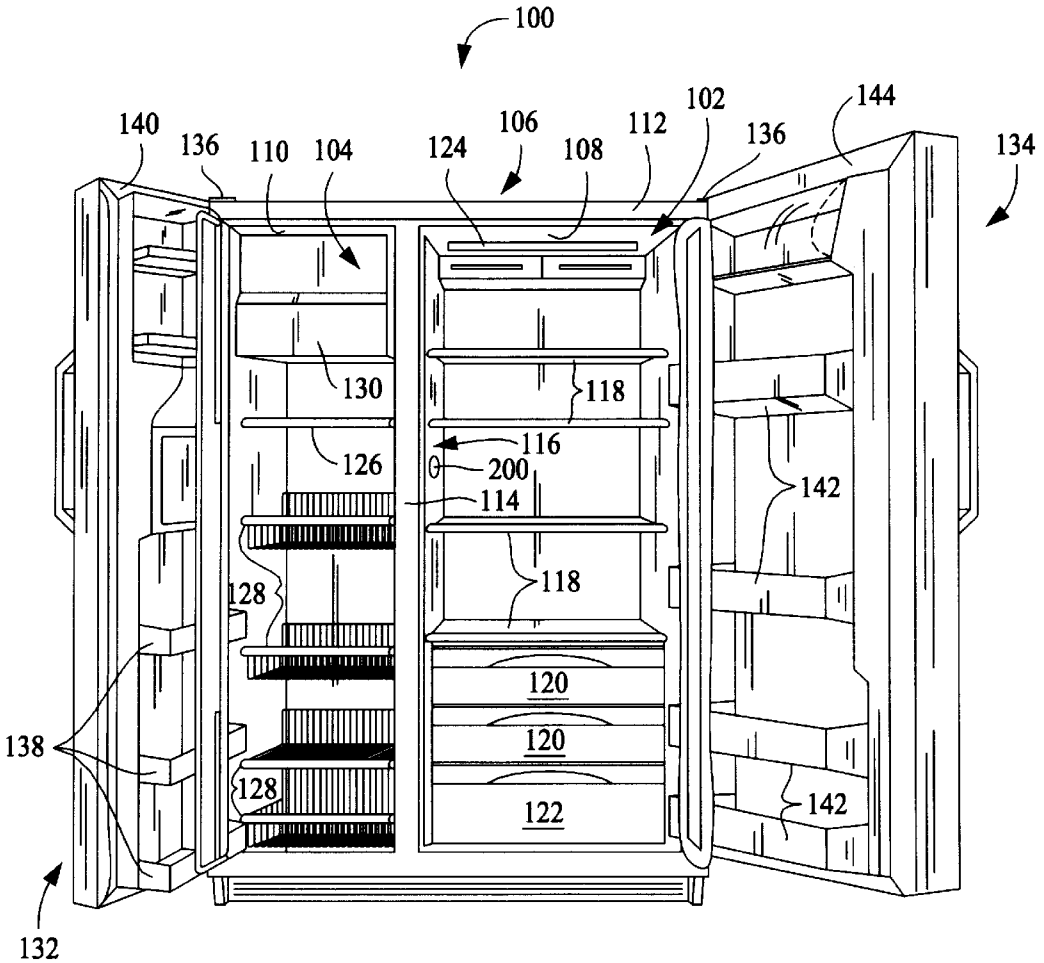
FIG. 1 is a perspective view of an exemplary refrigerator.

FIG. 1 illustrates a side-by-side refrigerator 100 in which the present invention may be practiced. It is recognized, however, that the benefits of the present invention apply to other types of refrigerators, freezers, refrigeration appliances, and refrigeration devices, including climate control systems having similar control issues and considerations. Consequently, the description set forth herein is for illustrative purposes only and is not intended to limit the invention in any aspect.

Refrigerator 100 includes a fresh food storage compartment 102 and a freezer storage compartment 104. Freezer compartment 104 and fresh food compartment 102 are arranged side-by-side in an outer case 106 with inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100.

Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. It will be understood that in a refrigerator with separate mullion dividing a unitary liner into a freezer and a fresh food compartment, a front face member of mullion corresponds to mullion 114. Breaker strip 112 and mullion 114 form a front face, and extend completely around inner peripheral edges of case 106 and vertically between liners 108, 110. Mullion 114, insulation between compartments 102, 104, and a spaced wall of liners 108, 110 separating compartments 102, 104 sometimes are collectively referred to herein as a center mullion wall 116.

Shelves 118 and slide-out drawers 120 normally are provided in fresh food compartment 102 to support items being stored therein. A bottom drawer or pan 122 partly forms a quick chill and thaw system (not shown) and selectively controlled, together with other refrigerator features, by a microprocessor (not shown in FIG. 1) according to user preference via manipulation of a control interface 124 mounted in an upper region of fresh food storage compartment 102 and coupled to the microprocessor. A shelf 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown in FIG. 1), a condenser (not shown in FIG. 1), an expansion device (not shown in FIG. 1), and an evaporator (not shown in FIG. 1) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown in FIG. 1). Collectively, the vapor compression cycle components in a refrigeration circuit, associated fans, and associated compartments are referred to herein as a sealed system. The construction of the sealed system is well known and therefore not described in detail herein, and the sealed system components are operable at varying speeds to force cold air through the refrigerator subject to the following control scheme.

Figure 2:
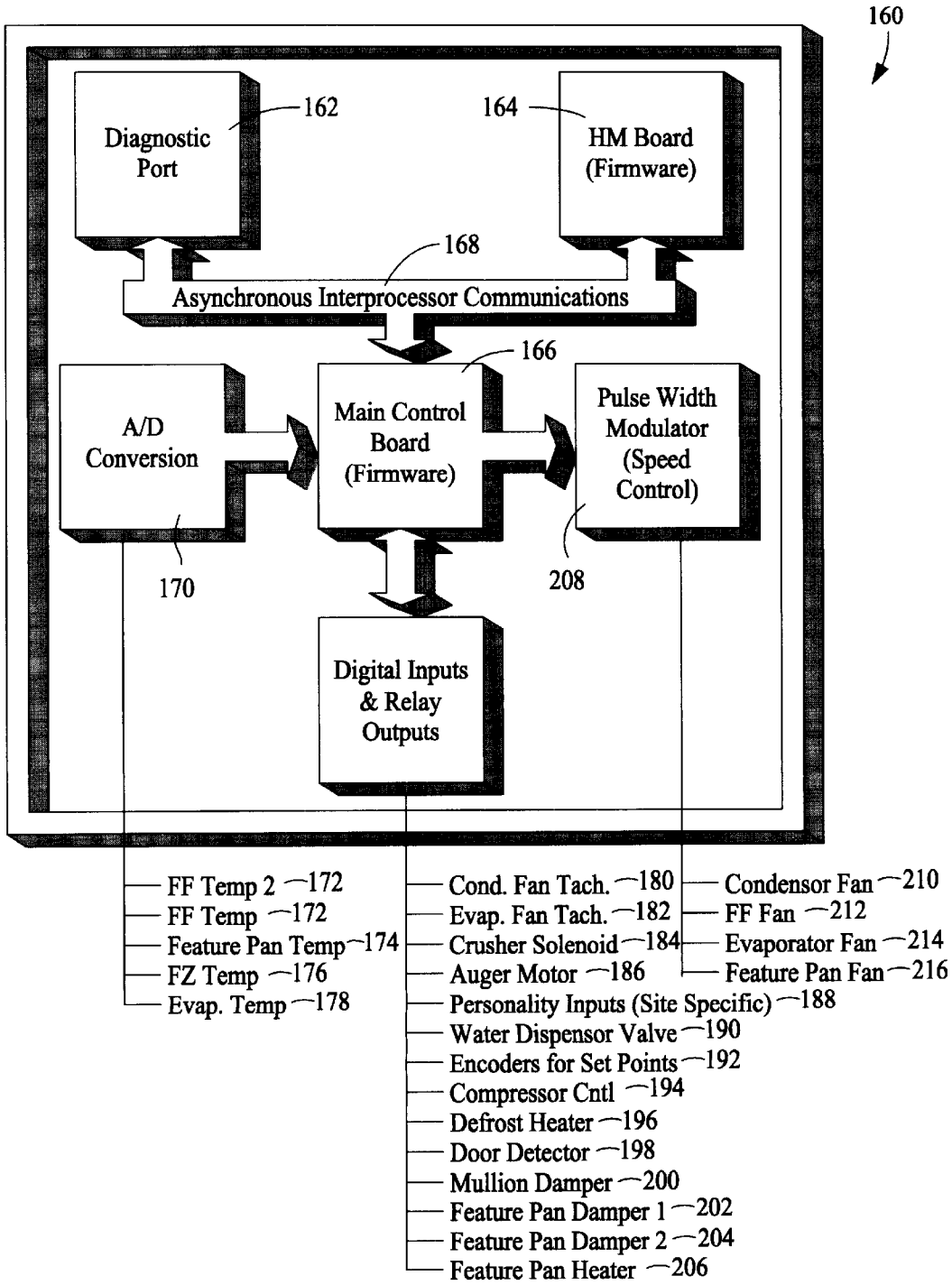
FIG. 2 is a block diagram of a refrigerator controller in accordance with one embodiment of the present invention.

FIG. 2 illustrates an exemplary controller 160 in accordance with one embodiment of the present invention. Controller 160 can be used, for example, in refrigerators, freezers and combinations thereof, such as, for example side-by-side refrigerator 100 (shown in FIG. 1).

Controller 160 includes a diagnostic port 162 and a human machine interface (HMI) board 164 coupled to a main control board 166 by an asynchronous interprocessor communications bus 168. An analog to digital converter ("A/D converter") 170 is coupled to main control board 166. A/D converter 170 converts analog signals from a plurality of sensors including one or more fresh food compartment temperature sensors 172, a quick chill/thaw feature pan (i.e., pan 122 shown in FIG. 1) temperature sensors 174, freezer temperature sensors 176, external temperature sensors (not shown in FIG. 2), and evaporator temperature sensors 178 into digital signals for processing by main control board 166.

In an alternative embodiment (not shown), A/D converter 170 digitizes other input functions (not shown), such as a power supply current and voltage, brownout detection, compressor cycle adjustment, analog time and delay inputs (both use based and sensor based) where the analog input is coupled to an auxiliary device (e.g., clock or finger pressure activated switch), analog pressure sensing of the compressor sealed system for diagnostics and power/energy optimization. Further input functions include external communication via IR detectors or sound detectors, HMI display dimming based on ambient light, adjustment of the refrigerator to react to food loading and changing the air flow/pressure accordingly to ensure food load cooling or heating as desired, and altitude adjustment to ensure even food load cooling and enhance pull-down rate at various altitudes by changing fan speed and varying air flow.

Digital input and relay outputs correspond to, but are not limited to, a condenser fan speed 180, an evaporator fan speed 182, a crusher solenoid 184, an auger motor 186, personality inputs 188, a water dispenser valve 190, encoders 192 for set points, a compressor control 194, a defrost heater 196, a door detector 198, a mullion damper 200, feature pan air handler dampers 202, 204, and a quick chill/thaw feature pan heater 206. Main control board 166 also is coupled to a pulse width modulator 208 for controlling the operating speed of a condenser fan 210, a fresh food compartment fan 212, an evaporator fan 214, and a quick chill system feature pan fan 216.

Figure 3A:
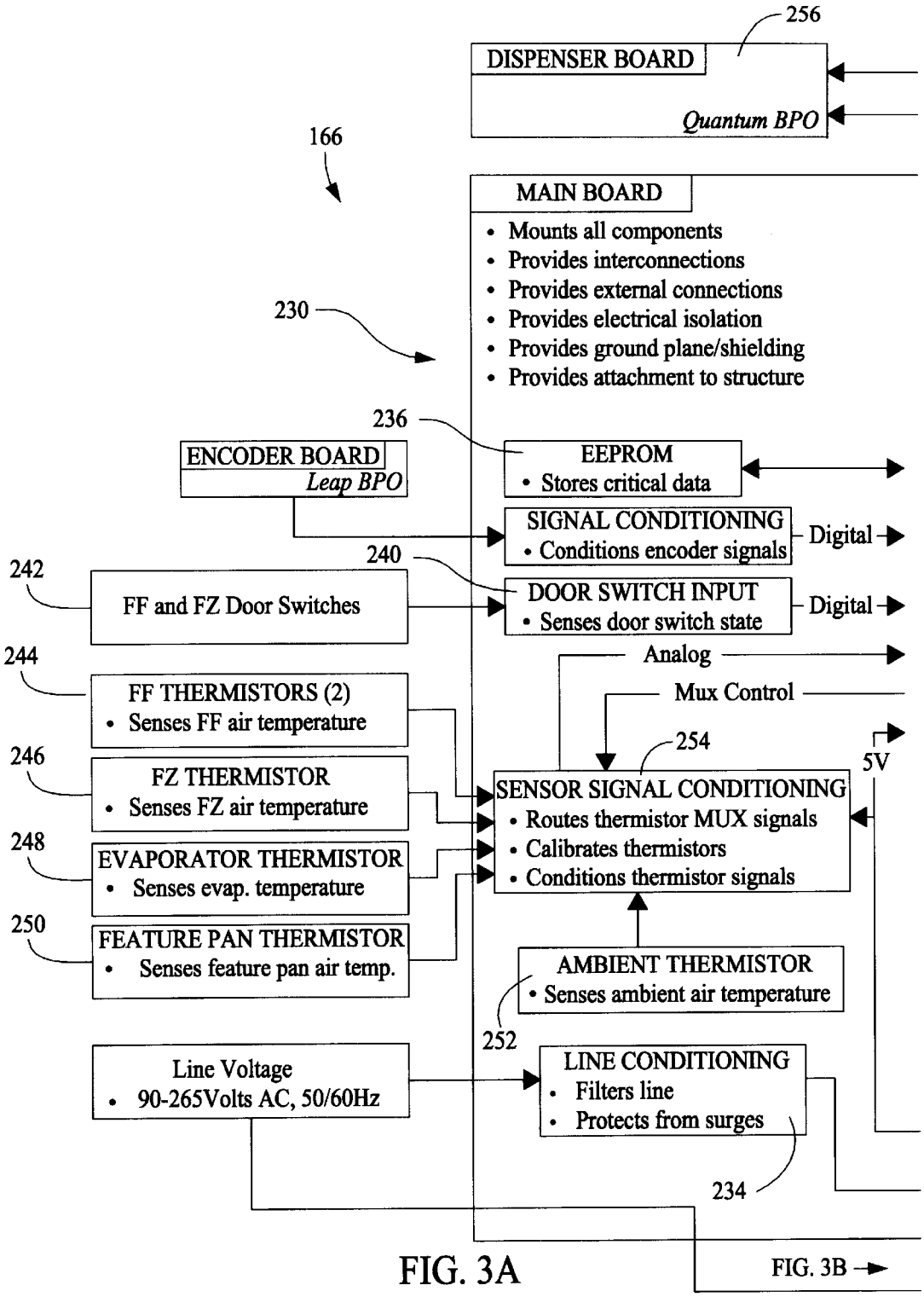
FIG. 3A is a portion of a block diagram of the main control board shown in FIG. 2.
Figure 3B:
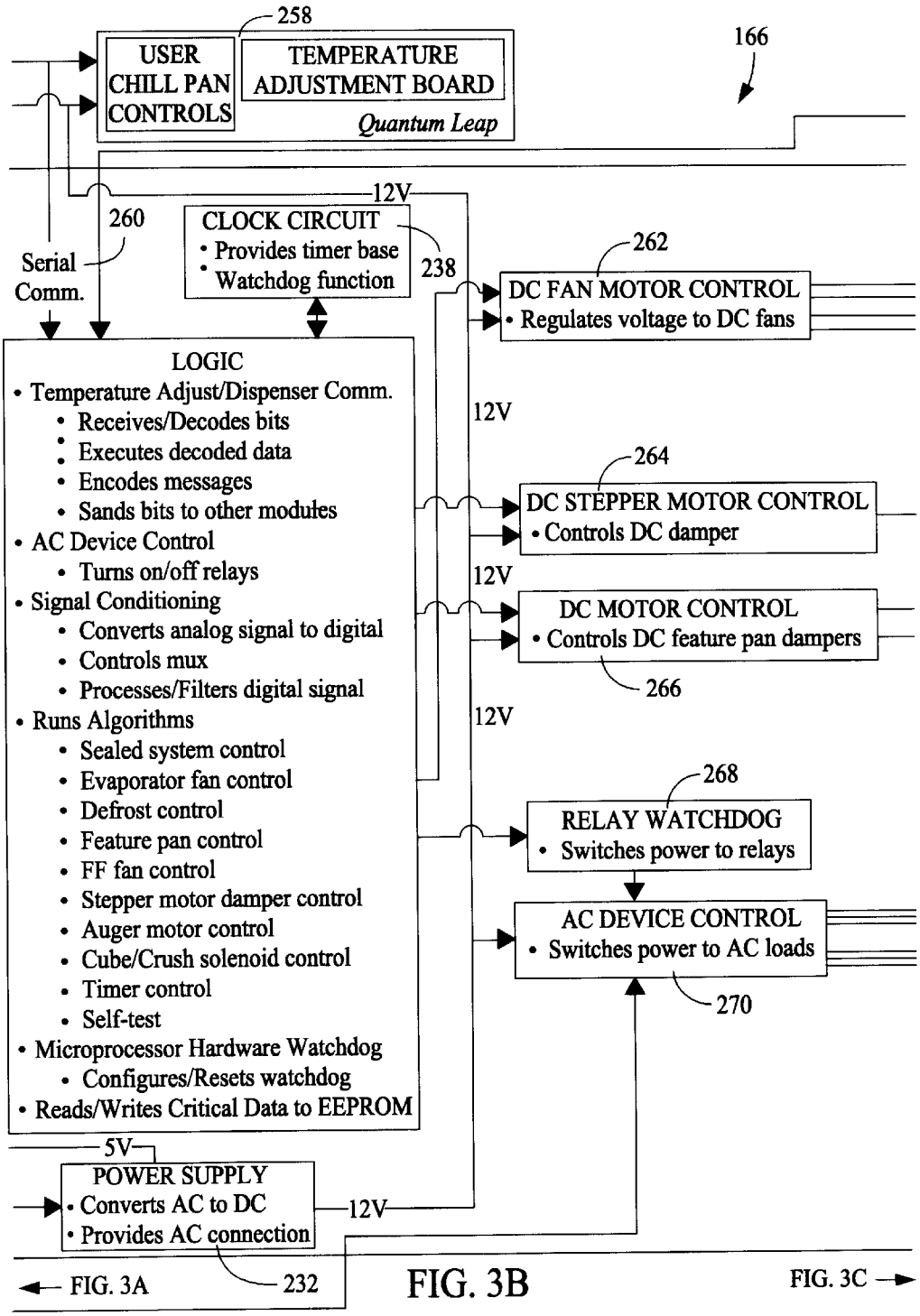
FIG. 3B is a portion of a block diagram of the main control board shown in FIG. 2.
Figure 3C:
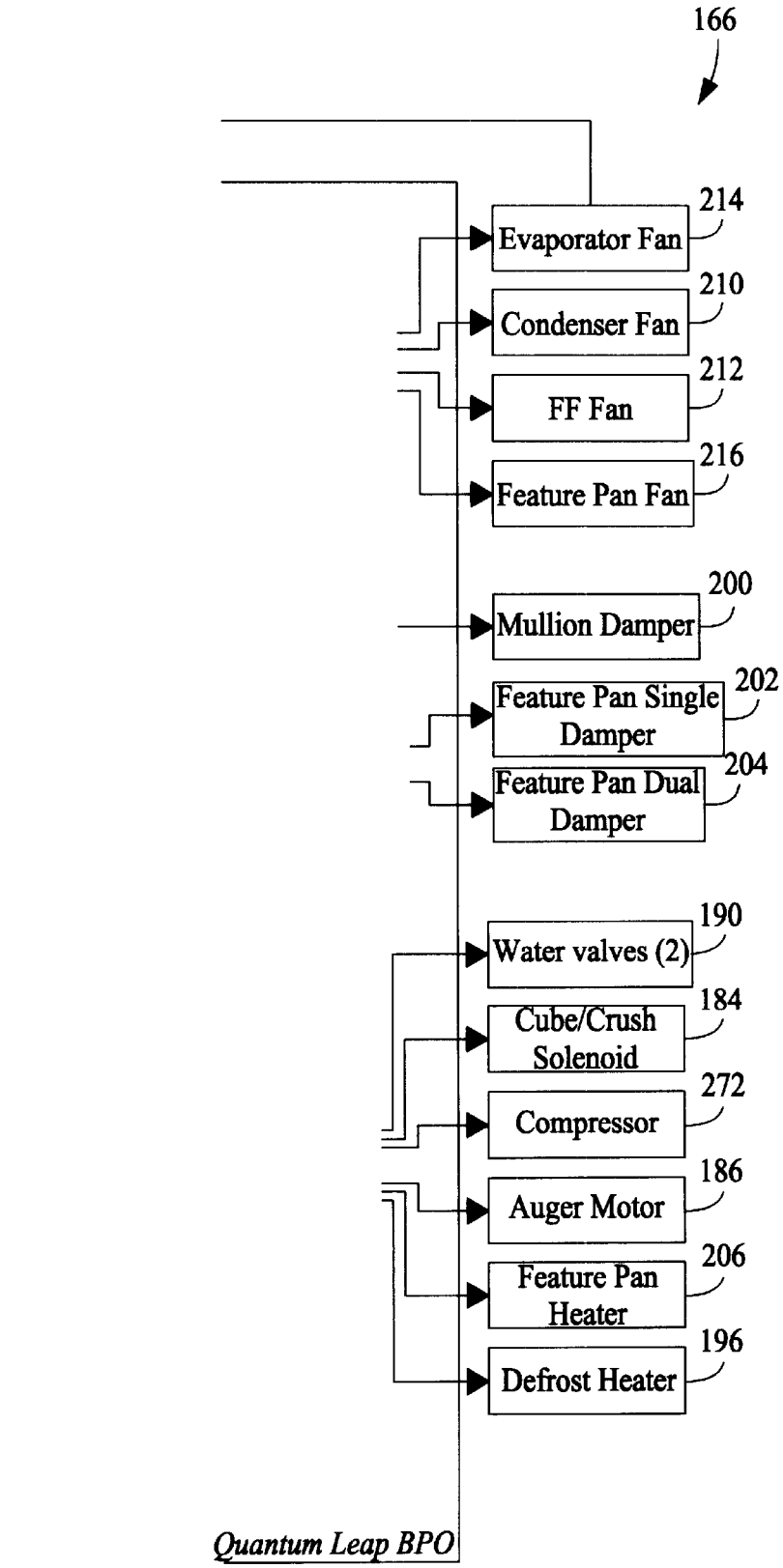
FIG. 3C portion of a block diagram of the main control board shown in FIG. 2.
Figure 4:
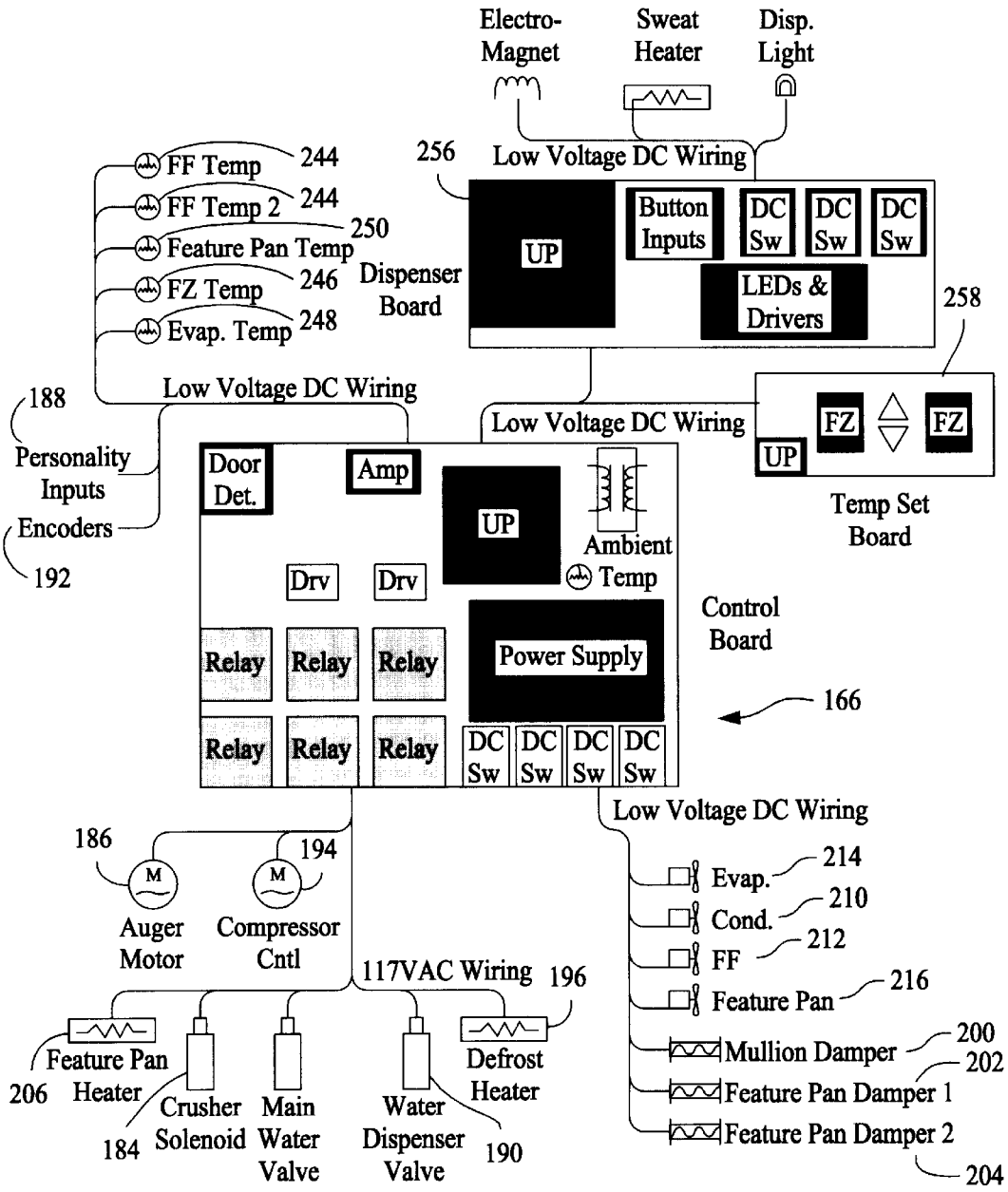
FIG. 4 is a block diagram of the main control board shown in FIG. 2.

FIGS. 3A, 3B, 3C (collectively referred to as FIG. 3), and 4 are more detailed block diagrams of main control board 166. As shown in FIGS. 3 and 4, main control board 166 includes a processor 230. Processor 230 performs temperature adjustments/dispenser communication, AC device control, signal conditioning, microprocessor hardware watchdog, and EEPROM read/write functions. In addition, processor 230 executes many control algorithms including sealed system control, evaporator fan control, defrost control, feature pan control, fresh food fan control, stepper motor damper control, water valve control, auger motor control, cube/crush solenoid control, timer control, and self-test operations.

Processor 230 is coupled to a power supply 232 which receives an AC power signal from a line conditioning unit 234. Line conditioning unit 234 filters a line voltage which is, for example, a 90–265 Volts AC, 50/60 Hz signal. Processor 230 also is coupled to an EEPROM 236 and a clock circuit 238.

A door switch input sensor 240 is coupled to fresh food and freezer door switches 242, and senses a door switch state. A signal is supplied from door switch input sensor 240 to processor 230, in digital form, indicative of the door switch state. Fresh food thermistors 244, a freezer thermistor 246, at least one evaporator thermistor 248, a feature pan thermistor 250, and an ambient thermistor 252 are coupled to processor 230 via a sensor signal conditioner 254. Conditioner 254 receives a multiplex control signal from processor 230 and provides analog signals to processor 230 representative of the respective sensed temperatures. Processor 230 also is coupled to a dispenser board 256 and a temperature adjustment board 258 via a serial communications link 260. Conditioner 254 also calibrates the above-described thermistors 244, 246, 248, 250, and 252.

Processor 230 provides control outputs to a DC fan motor control 262, a DC stepper motor control 264, a DC motor control 266, and a relay watchdog 268. Watchdog 268 is coupled to an AC device controller 270 that provides power to AC loads, such as to water valve 190, cube/crush solenoid 184, a compressor 272, auger motor 186, a feature pan heater 206, and defrost heater 196. DC fan motor control 266 is coupled to evaporator fan 214, condenser fan 210, fresh food fan 212, and feature pan fan 216. DC stepper motor control 266 is coupled to mullion damper 200, and DC motor control 266 is coupled to one of more sealed system dampers.

Periodically, controller 160 reads fresh food compartment thermistors 244 and freezer thermistor 246 to determine respective temperatures of fresh food compartment 102 (shown in FIG. 1) and freezer compartment 104 (shown in FIG. 1). Based on the determined temperatures of compartments 102, 104, controller 160 makes control algorithm decisions, including selection of operating speed of the various sealed system components, as described below.

Additionally, mullion damper 200 is toggled on a periodic basis to prevent frost buildup that may impair movement of mullion damper 200 or prevent proper operation thereof. That is, when the damper is in a closed position it is toggled to an opened position and returned to the closed position, and when the damper is in an opened position it is toggled to the closed position and returned to the open position. In an exemplary embodiment, damper 200 is toggled at thirty minute intervals. In alternative embodiments, however, damper 200 may be toggled more regularly or less regularly. For example, damper is toggled periodically with a periodicity of between approximately 10 minutes and approximately 60 minutes, with a periodicity between approximately 15 minutes and approximately 45 minutes, with a periodicity between approximately 25 minutes and approximately 35 minutes, with a periodicity between approximately 15 minutes and approximately 50 minutes, with a periodicity between approximately 20 minutes and approximately 40 minutes, or with a periodicity between approximately 25 minutes and approximately 35 minutes. Additionally, toggling may occur the same or different time that compartment temperatures are read or control parameters are adjusted. Also toggling is both done during a defrost mode in which the temperature of freezer compartment 104 is allowed to warm up, and during a cooling mode in which one or both of freezer compartment 104 and fresh food compartment 102 are being cooled.

By toggling damper 200 on a periodic basis, any ice that builds up on damper 200 and/or damper gears (not shown) is broken up and does not allow a substantial amount of ice build up such that damper 200 is frozen in one position and no longer moveable. Accordingly, a cost effective refrigerator is provided that is long lasting and has an improved damping system over known damping systems.

While the invention has been described in terms of various specific embodiments, those skilled in the art will recognize that the invention can be practiced with modification within the spirit and scope of the claims.

What is claimed is:

1. A method for controlling a damper having a closed position and an open position for providing flow communication between a first cooled compartment and a second cooled compartment, said method comprising:

toggling the damper from an initial position of the damper to a position different from the initial position and then back to the initial position on a periodic basis.

2. A method in accordance with claim 1 wherein said toggling further comprises toggling the damper from the damper's initial position to a position different from the initial position and then back to the initial position on a periodic basis with a periodicity between approximately 10 minutes and approximately 60 minutes.

3. A method in accordance with claim 1 wherein said toggling further comprises toggling the damper from the damper's initial position to a position different from the initial position and then back to the initial position on a periodic basis with a periodicity between approximately 15 minutes and approximately 45 minutes.

4. A method in accordance with claim 1 wherein said toggling further comprises toggling the damper from the damper's initial position to a position different from the initial position and then back to the initial position on a periodic basis with a periodicity between approximately 25 minutes and approximately 35 minutes.

5. A method in accordance with claim 1 wherein said toggling further comprises toggling the damper from the damper's initial position to a position different from the initial position and then back to the initial position approximately every 30 minutes.

6. A cooling device comprising:

a first compartment comprising a plurality of first walls and at least one first door defining a first enclosed volume of said first compartment;

a second compartment comprising a plurality of second walls and at least one first door defining a first enclosed volume of said second compartment with one of said first walls;

a damper between said first compartment and said second compartment, said damper movable to change an amount of flow communication between said first compartment and said second compartment;

a sealed system configured to provide cooling capacity to said first compartment and said second compartment operationally coupled to said first compartment and to said second compartment; and a temperature control system operationally coupled to said damper and to said sealed system, said control system configured to:

toggle said damper from an initial position to a position different from the initial position and then back to the initial position on a periodic basis.

7. A device in accordance with claim 6 wherein said control system further configured to toggle said damper with a periodicity between approximately every 10 minutes and approximately every 60 minutes.

8. A device in accordance with claim 6 wherein said control system further configured to toggle said damper with a periodicity between approximately 15 minutes and approximately 50 minutes.

9. A device in accordance with claim 6 wherein said control system further configured to toggle said damper with a periodicity between approximately 20 minutes and approximately 40 minutes.

10. A device in accordance with claim 6 wherein said control system further configured to toggle said damper with a periodicity between approximately 25 minutes and approximately 35 minutes.

11. A device in accordance with claim 6 wherein said control system further configured to toggle said damper with a periodicity of approximately 30 minutes.

12. A device in accordance with claim 6 wherein said control system further configured to toggle said damper with a periodicity between approximately every 15 minutes and approximately every 50 minutes during a cooling mode.

13. A device in accordance with claim 6 wherein said control system further configured to toggle said damper with a periodicity between approximately every 15 minutes and approximately every 50 minutes during a defrost mode.

14. A device in accordance with claim 13 wherein said control system further configured to toggle said damper with a periodicity between approximately every 25 minutes and approximately every 35 minutes.

15. A device in accordance with claim 6 wherein said control system further configured to:

maintain said first compartment at a temperature above freezing; and maintain said second compartment at a temperature below freezing.

16. A device in accordance with claim 15 wherein said control system further configured to toggle said damper with a periodicity between approximately every 15 minutes and approximately every 50 minutes.

17. A refrigerator comprising:

a first compartment configured to preserve food, said first compartment comprising a plurality of first walls and at least one first door defining a first enclosed volume of said first compartment;

a second compartment configured to preserve food coupled to one of said first walls, said second compartment comprising a plurality of second walls and at least one second door defining a second enclosed volume of said second compartment with one of said first walls comprising a damper movable to change an amount of flow communication between said first compartment and said second compartment;

a sealed system operationally coupled to said first and second compartments, said sealed system configured to provide cooling capacity to said first and second compartments;

a temperature control system operationally coupled to said sealed system and to said damper, said control system configured to:

maintain said first compartment at a first temperature;

maintain said second compartment at a second temperature different from said first temperature; and toggle said damper from an initial position to a position different from the initial position and then back to the initial position on a periodic basis.

18. A refrigerator according to claim 17 wherein said control further configured to:

maintain said first compartment at a first temperature above freezing;

maintain said second compartment at a second temperature below freezing; and toggle said damper from an initial position to a position different from the initial position and then back to the initial position on a periodic basis with a periodicity of between about 15 minutes and about 45 minutes.

19. A refrigerator according to claim 17 wherein said control further configured to toggle said damper from an initial position to a position different from the initial position and then back to the initial position on a periodic basis with a periodicity of between about 25 minutes and about 35 minutes.

20. A refrigerator according to claim 19 wherein said control further configured to toggle said damper from an initial position to a position different from the initial position and then back to the initial position on a periodic basis with a periodicity of about 30 minutes.

* * * * *

UNITED STATES PATENT AND TRADEMARK OFFICE

CERTIFICATE OF CORRECTION

PATENT NO. : 6,557,362 B1
DATED : May 6, 2003
INVENTOR(S) : Wilson

It is certified that error appears in the above-identified patent and that said Letters Patent is hereby corrected as shown below:

Column 6,
Line 38, delete "first door defining a first enclosed" and insert therefore
-- second door defining a second enclosed --.

Signed and Sealed this

Seventh Day of October, 2003

JAMES E. ROGAN
*Director of the United States Patent and Trademark Office*